US007377510B2

(12) United States Patent
Sato

(10) Patent No.: US 7,377,510 B2
(45) Date of Patent: May 27, 2008

(54) DELIVERY APPARATUS AND DELIVERY METHOD

(75) Inventor: Fuminori Sato, Noda (JP)

(73) Assignee: Komori Corporation, Tokyo (JP)

( * ) Notice: Subject to any disclaimer, the term of this patent is extended or adjusted under 35 U.S.C. 154(b) by 112 days.

(21) Appl. No.: 10/952,851

(22) Filed: Sep. 30, 2004

(65) Prior Publication Data

US 2005/0073086 A1 Apr. 7, 2005

(30) Foreign Application Priority Data

Oct. 1, 2003 (JP) ..... 2003-342789

(51) Int. Cl.
*B65H 5/12* (2006.01)

(52) U.S. Cl. ..... 271/266; 101/232

(58) Field of Classification Search ..... 271/176, 271/178, 270, 199, 69, 266; 101/118, 227, 101/232, 233; 270/45, 46, 50; 198/419.2, 198/576, 577, 575, 579
See application file for complete search history.

(56) References Cited

U.S. PATENT DOCUMENTS 3,945,635 A * 3/1976 Marin ..... 271/202
4,067,568 A * 1/1978 Irvine ..... 271/176
4,073,487 A * 2/1978 Schirrmeister et al. ..... 271/279
4,088,314 A * 5/1978 Phillips ..... 271/176
4,244,565 A * 1/1981 Geier ..... 271/176
4,361,318 A * 11/1982 Stobb ..... 271/202
4,470,590 A * 9/1984 Ariga et al. ..... 271/187
4,593,896 A * 6/1986 Nakamura ..... 271/186
4,638,993 A * 1/1987 Granzow et al. ..... 271/315
4,667,951 A * 5/1987 Honjo et al. ..... 271/259
4,844,439 A * 7/1989 Johansson ..... 271/192
4,948,114 A * 8/1990 Bowman et al. ..... 271/202
5,004,094 A * 4/1991 Brandt ..... 198/460.1
5,253,860 A * 10/1993 Hirose et al. ..... 271/176
5,288,066 A * 2/1994 Hain ..... 271/181
5,322,154 A * 6/1994 Lenherr ..... 198/460.2
5,480,032 A * 1/1996 Pippin et al. ..... 209/583
5,501,147 A * 3/1996 Jaffa et al. ..... 101/118
5,641,156 A * 6/1997 Nukada et al. ..... 271/176
5,906,265 A * 5/1999 Spatafora ..... 198/460.2
6,321,650 B1 * 11/2001 Ogawa et al. ..... 101/227
6,494,447 B2 * 12/2002 Myer, Sr. ..... 271/176
6,554,273 B1 * 4/2003 Holland-Letz et al. ..... 271/176
6,572,097 B2 * 6/2003 d'Agrella et al. ..... 271/182
6,623,001 B2 * 9/2003 Steinkogler et al. ..... 271/176
6,640,961 B2 * 11/2003 Cavallari ..... 198/460.2
6,698,951 B2 * 3/2004 Kitai et al. ..... 400/74
6,796,557 B2 * 9/2004 Watanabe et al. ..... 271/176
2001/0045697 A1 * 11/2001 Daout et al. ..... 271/266

(Continued)

FOREIGN PATENT DOCUMENTS

JP 11-11769 A 1/1999

*Primary Examiner*—Patrick Mackey
*Assistant Examiner*—Jeremy R Severson
(74) *Attorney, Agent, or Firm*—Birch, Stewart, Kolasch & Birch, LLP

(57) ABSTRACT

In a delivery apparatus having a delivery conveyor for receiving and transporting a signature discharged from a printing press, the delivery conveyor is continuously driven if the drive speed of the printing press is higher than a predetermined speed, or the delivery conveyor is intermittently driven if the drive speed of the printing press is lower than the predetermined speed.

14 Claims, 12 Drawing Sheets

U.S. PATENT DOCUMENTS

2001/0050458 A1* 12/2001 Myer ..... 271/176
2002/0195315 A1* 12/2002 Cavallari ..... 198/419.2
2003/0006548 A1* 1/2003 Murata et al. ..... 271/256
2003/0127789 A1* 7/2003 Bakodledis ..... 271/176

* cited by examiner

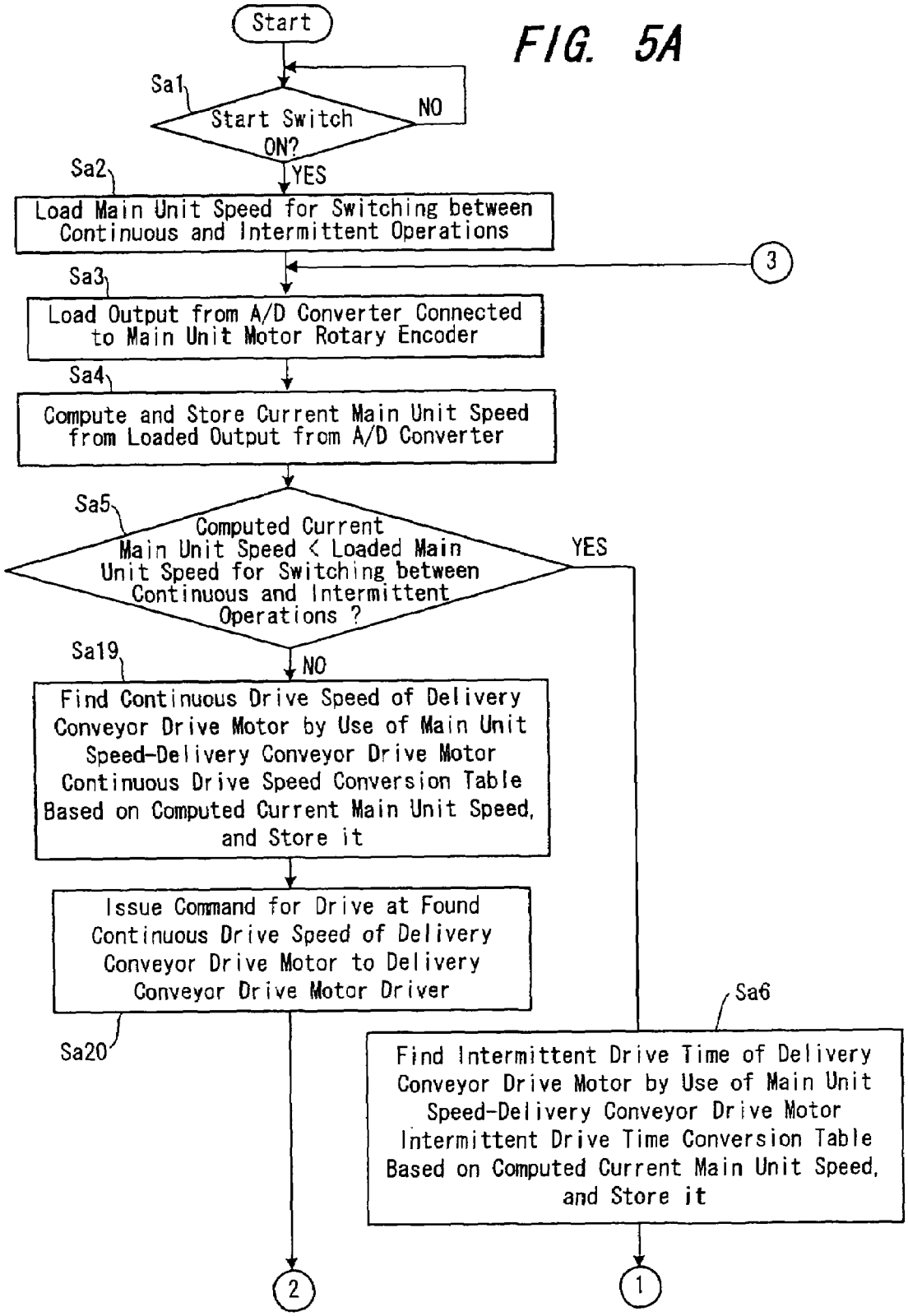
FIG. 5A
Start
Sa1
Start Switch ON?
NO
YES
Sa2
Load Main Unit Speed for Switching between Continuous and Intermittent Operations
3
Sa3
Load Output from A/D Converter Connected to Main Unit Motor Rotary Encoder
Sa4
Compute and Store Current Main Unit Speed from Loaded Output from A/D Converter
Sa5
Computed Current Main Unit Speed < Loaded Main Unit Speed for Switching between Continuous and Intermittent Operations ?
YES
NO
Sa19
Find Continuous Drive Speed of Delivery Conveyor Drive Motor by Use of Main Unit Speed-Delivery Conveyor Drive Motor Continuous Drive Speed Conversion Table Based on Computed Current Main Unit Speed, and Store it
Issue Command for Drive at Found Continuous Drive Speed of Delivery Conveyor Drive Motor to Delivery Conveyor Drive Motor Driver
Sa20
Sa6
Find Intermittent Drive Time of Delivery Conveyor Drive Motor by Use of Main Unit Speed-Delivery Conveyor Drive Motor Intermittent Drive Time Conversion Table Based on Computed Current Main Unit Speed, and Store it
2
1

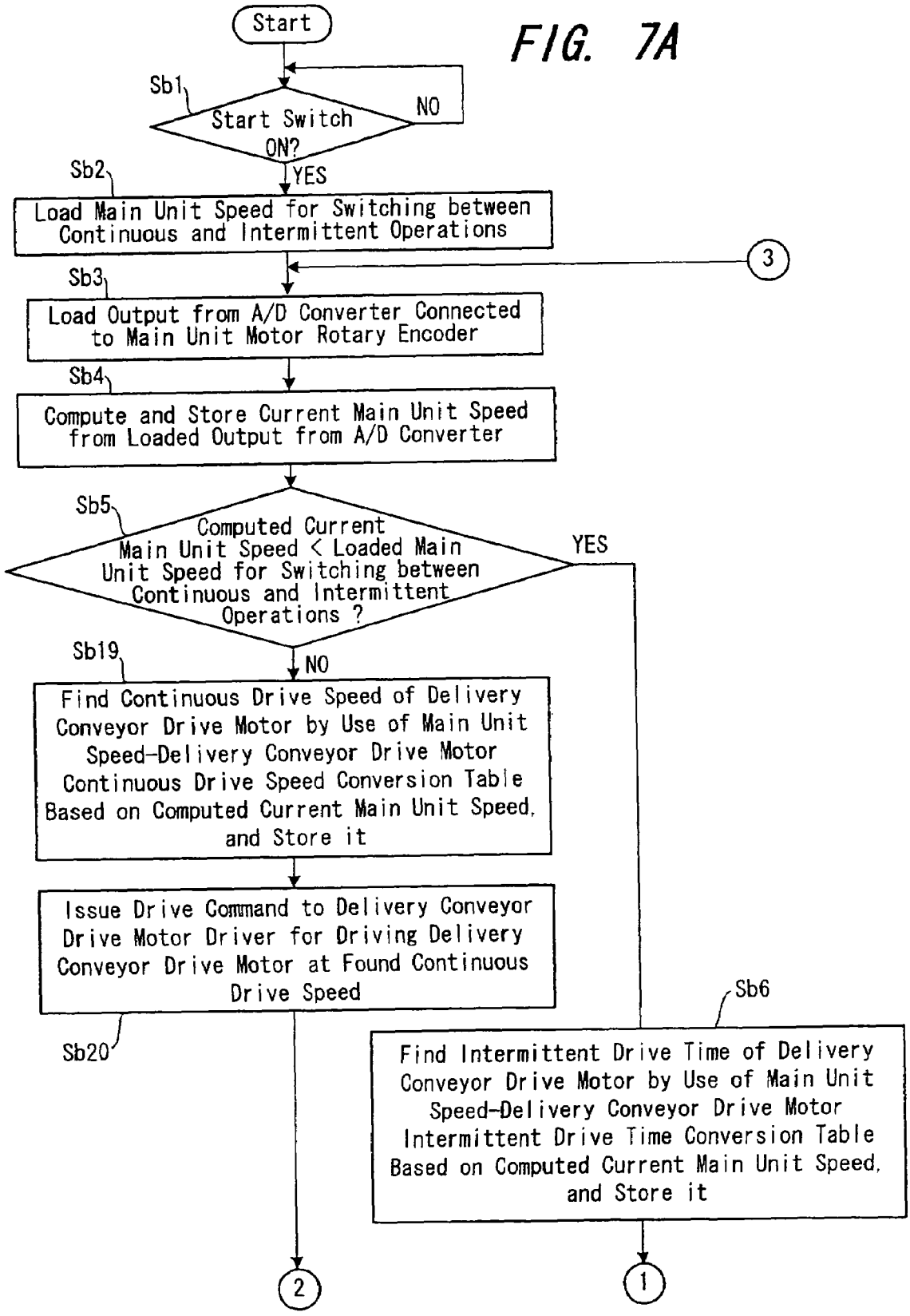
FIG. 7A
Start
Sb1
Start Switch ON?
NO
YES
Sb2
Load Main Unit Speed for Switching between Continuous and Intermittent Operations
3
Sb3
Load Output from A/D Converter Connected to Main Unit Motor Rotary Encoder
Sb4
Compute and Store Current Main Unit Speed from Loaded Output from A/D Converter
Sb5
Computed Current Main Unit Speed < Loaded Main Unit Speed for Switching between Continuous and Intermittent Operations ?
YES
NO
Sb19
Find Continuous Drive Speed of Delivery Conveyor Drive Motor by Use of Main Unit Speed-Delivery Conveyor Drive Motor Continuous Drive Speed Conversion Table Based on Computed Current Main Unit Speed, and Store it
Issue Drive Command to Delivery Conveyor Drive Motor Driver for Driving Delivery Conveyor Drive Motor at Found Continuous Drive Speed
Sb20
Sb6
Find Intermittent Drive Time of Delivery Conveyor Drive Motor by Use of Main Unit Speed-Delivery Conveyor Drive Motor Intermittent Drive Time Conversion Table Based on Computed Current Main Unit Speed, and Store it
2
1

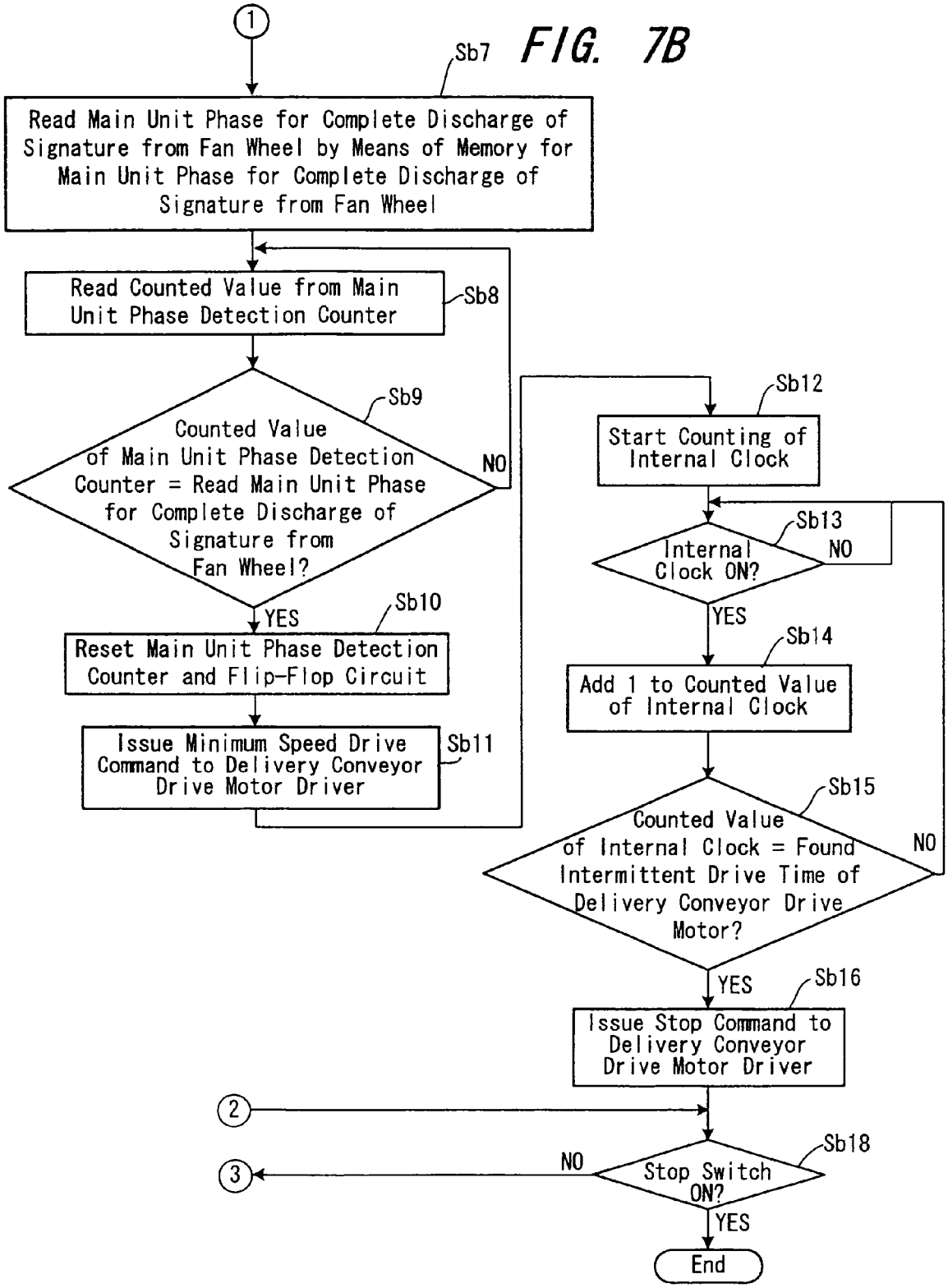
FIG. 7B
1
Sb7
Read Main Unit Phase for Complete Discharge of Signature from Fan Wheel by Means of Memory for Main Unit Phase for Complete Discharge of Signature from Fan Wheel
Read Counted Value from Main Unit Phase Detection Counter
Sb8
Sb9
Counted Value of Main Unit Phase Detection Counter = Read Main Unit Phase for Complete Discharge of Signature from Fan Wheel?
NO
YES
Sb10
Reset Main Unit Phase Detection Counter and Flip-Flop Circuit
Issue Minimum Speed Drive Command to Delivery Conveyor Drive Motor Driver
Sb11
Sb12
Start Counting of Internal Clock
Sb13
Internal Clock ON?
NO
YES
Sb14
Add 1 to Counted Value of Internal Clock
Sb15
Counted Value of Internal Clock = Found Intermittent Drive Time of Delivery Conveyor Drive Motor?
NO
YES
Sb16
Issue Stop Command to Delivery Conveyor Drive Motor Driver
2
Sb18
Stop Switch ON?
NO
3
YES
End

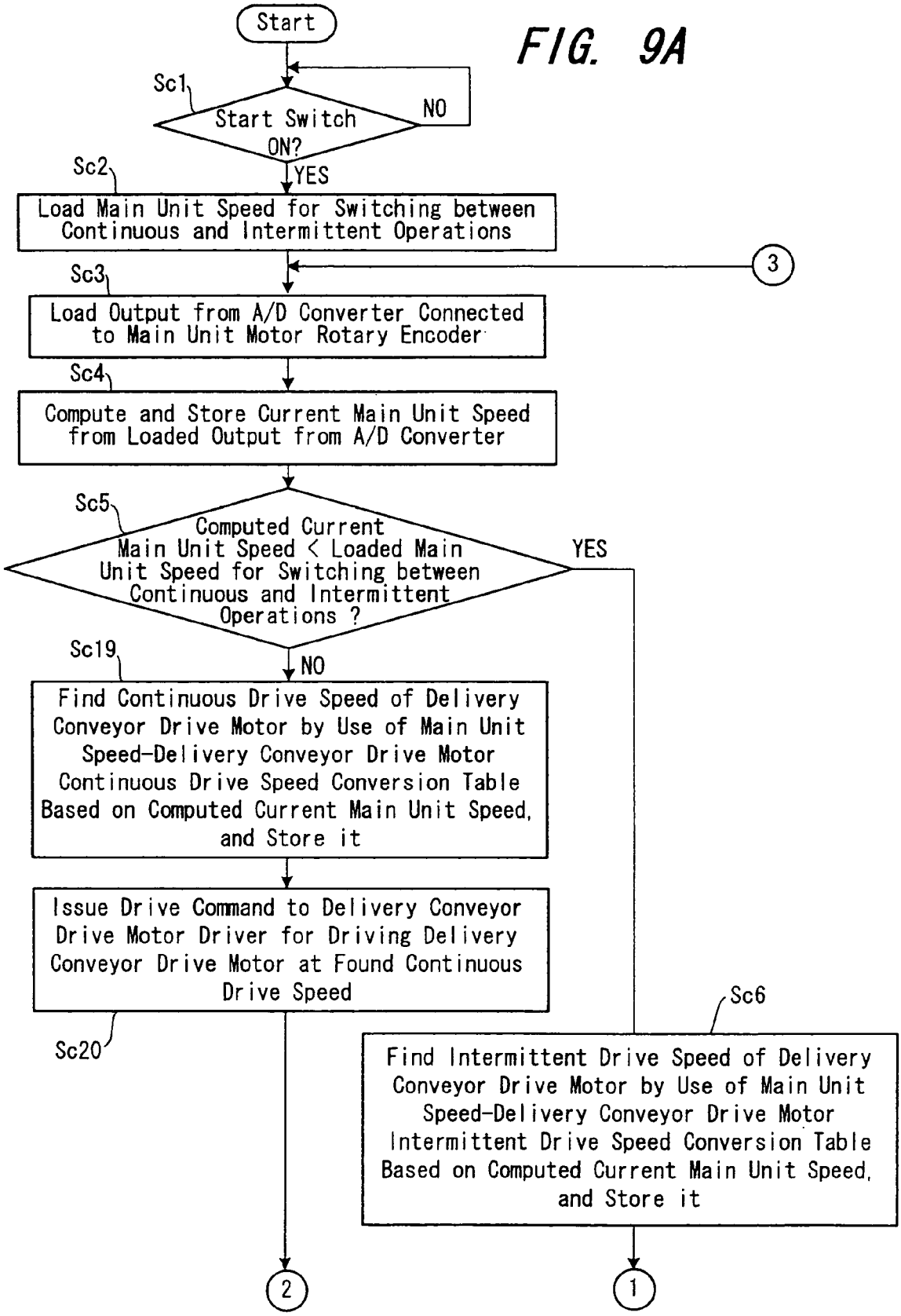
FIG. 9A
Start
Sc1
Start Switch ON?
NO
YES
Sc2
Load Main Unit Speed for Switching between Continuous and Intermittent Operations
3
Sc3
Load Output from A/D Converter Connected to Main Unit Motor Rotary Encoder
Sc4
Compute and Store Current Main Unit Speed from Loaded Output from A/D Converter
Sc5
Computed Current Main Unit Speed < Loaded Main Unit Speed for Switching between Continuous and Intermittent Operations ?
YES
NO
Sc19
Find Continuous Drive Speed of Delivery Conveyor Drive Motor by Use of Main Unit Speed-Delivery Conveyor Drive Motor Continuous Drive Speed Conversion Table Based on Computed Current Main Unit Speed, and Store it
Issue Drive Command to Delivery Conveyor Drive Motor Driver for Driving Delivery Conveyor Drive Motor at Found Continuous Drive Speed
Sc20
Sc6
Find Intermittent Drive Speed of Delivery Conveyor Drive Motor by Use of Main Unit Speed-Delivery Conveyor Drive Motor Intermittent Drive Speed Conversion Table Based on Computed Current Main Unit Speed, and Store it
2
1

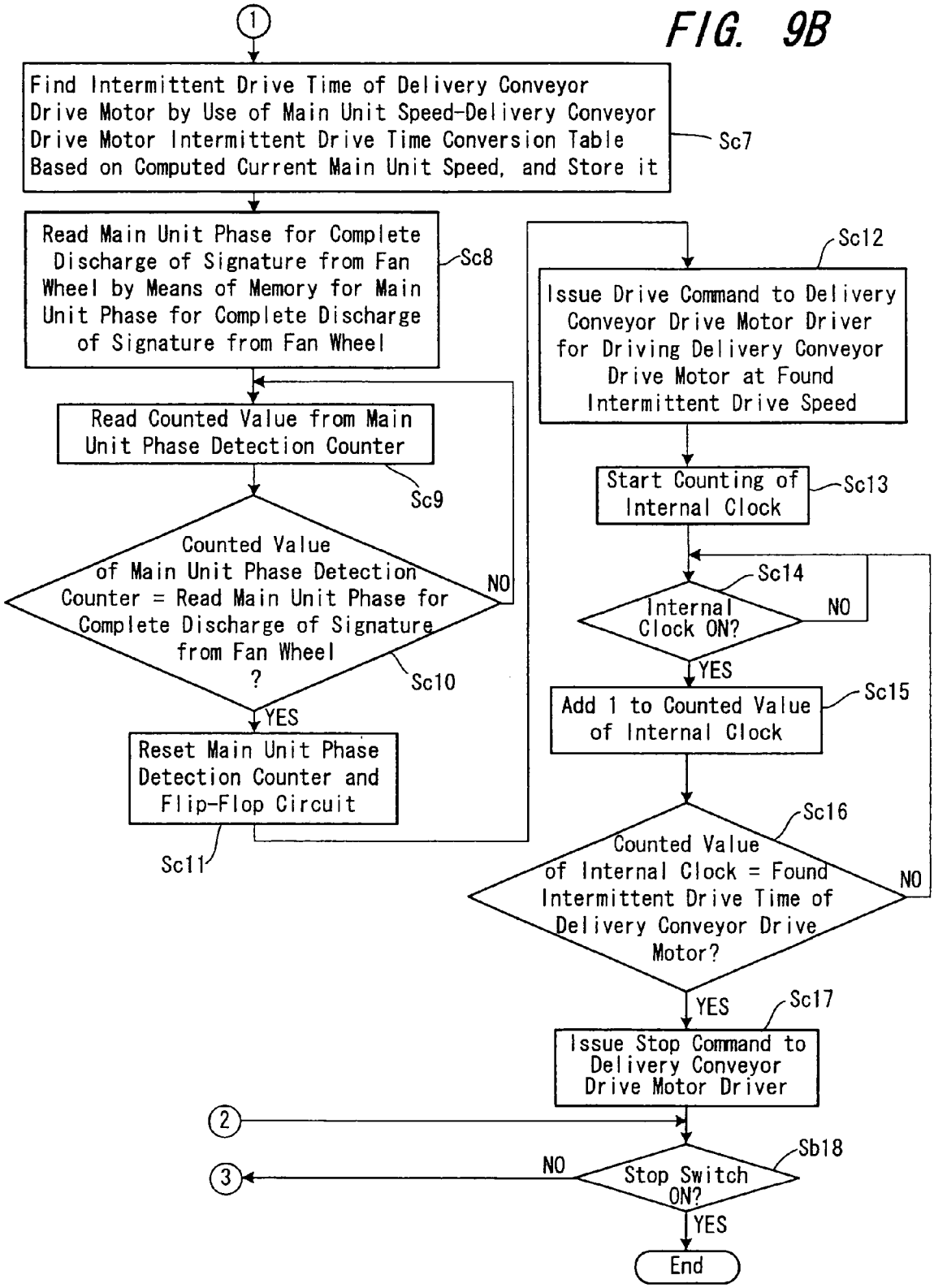
FIG. 9B
1
Find Intermittent Drive Time of Delivery Conveyor Drive Motor by Use of Main Unit Speed-Delivery Conveyor Drive Motor Intermittent Drive Time Conversion Table Based on Computed Current Main Unit Speed, and Store it
Sc7
Read Main Unit Phase for Complete Discharge of Signature from Fan Wheel by Means of Memory for Main Unit Phase for Complete Discharge of Signature from Fan Wheel
Sc8
Read Counted Value from Main Unit Phase Detection Counter
Sc9
Counted Value of Main Unit Phase Detection Counter = Read Main Unit Phase for Complete Discharge of Signature from Fan Wheel ?
NO
YES
Sc10
Reset Main Unit Phase Detection Counter and Flip-Flop Circuit
Sc11
Sc12
Issue Drive Command to Delivery Conveyor Drive Motor Driver for Driving Delivery Conveyor Drive Motor at Found Intermittent Drive Speed
Start Counting of Internal Clock
Sc13
Sc14
Internal Clock ON?
NO
YES
Add 1 to Counted Value of Internal Clock
Sc15
Sc16
Counted Value of Internal Clock = Found Intermittent Drive Time of Delivery Conveyor Drive Motor?
NO
YES
Sc17
Issue Stop Command to Delivery Conveyor Drive Motor Driver
2
Sb18
Stop Switch ON?
NO
3
YES
End

DELIVERY APPARATUS AND DELIVERY METHOD

CROSS REFERENCE TO RELATED APPLICATION

The entire disclosure of Japanese Patent Application No. 2003-342789 filed on Oct. 1, 2003, including specification, claims, drawings, and summary, is incorporated herein by reference in its entirety.

BACKGROUND OF THE INVENTION

1. Field of the Invention

This invention relates to a delivery apparatus and a delivery method used, for example, in conjunction with a printing press.

2. Description of the Related Art

Conventionally, a delivery conveyor of a web rotary press has been driven by a dedicated motor. To facilitate handling of signatures in a subsequent step, the signatures always need to be delivered, while being arranged in an overlapping state with a constant spacing of 20 to 50 mm provided between the front ends of the adjacent signatures. If the signatures do not overlap and there is a clearance between the signatures, a jam detector installed downstream in the direction of delivery erroneously detects a jam. To avoid this erroneous detection, it is necessary to synchronize the drive speed of the delivery conveyor with the drive speed of the printing press. For this purpose, it has been required to use a motor whose speed can be varied in the range of 120 to 30,000 mm, namely, in a 250-fold speed range from a low speed to a high speed.

Such a delivery apparatus is disclosed in Japanese Patent Application Laid-Open No. 1999-11769.

The conventional delivery conveyor of a web rotary press, as described above, uses a motor whose speed is variable in a broad range. This has posed the problem of necessitating an expensive motor having a large capacity.

SUMMARY OF THE INVENTION

The present invention has solved the above-described problem in the following manner: If the printing press is operated at a speed higher than a certain drive speed, the delivery conveyor is continuously driven. If the printing press is operated at a speed lower than the certain drive speed, the delivery conveyor is intermittently driven. Moreover, the necessary variable speed range of the motor for driving is restricted to 25 times. Thus, an ordinary inexpensive small motor can be used.

It is an object of the present invention, therefore, to provide a delivery apparatus having a delivery conveyor driven at a low to high speed with the use of an inexpensive small motor; and a delivery method performed by the delivery conveyor with the use of the motor.

A delivery apparatus according to a first aspect of the invention, for attaining the above object, is a delivery apparatus having a delivery conveyor for receiving and transporting a printing product discharged from a printing press, wherein the delivery conveyor is continuously driven if a drive speed of the printing press is higher than a predetermined speed, or the delivery conveyor is intermittently driven if the drive speed of the printing press is lower than the predetermined speed.

According to a second aspect of the invention, in the first aspect of the invention, a drive speed of the delivery conveyor when intermittently driven may be a minimum drive speed of the delivery conveyor.

According to a third aspect of the invention, in the first aspect of the invention, a drive time and a stop time of the delivery conveyor when intermittently driven may be determined based on the drive speed of the printing press.

According to a fourth aspect of the invention, in the first aspect of the invention, when the delivery conveyor is to be intermittently driven, a drive time of the delivery conveyor may be determined based on the drive speed of the printing press, and at a time when the printing product is completely discharged to the delivery conveyor, driving of the delivery conveyor may be started.

According to a fifth aspect of the invention, in the first aspect of the invention, when the delivery conveyor is to be intermittently driven, a drive speed and a drive time of the delivery conveyor may be determined based on the drive speed of the printing press, and at a time when the printing product is completely discharged to the delivery conveyor, driving of the delivery conveyor may be started.

According to a sixth aspect of the invention, in the fifth aspect of the invention, when the delivery conveyor is to be intermittently driven, the drive time of the delivery conveyor may be a period of time from complete discharge of the printing product to the delivery conveyor until start of discharge of a next printing product to the delivery conveyor.

According to a seventh aspect of the invention, in the first aspect of the invention, a drive device for driving the delivery conveyor may be further included, and a maximum drive speed of the drive device may be not more than 25 times a minimum drive speed of the drive device.

A delivery method according to an eighth aspect of the invention, for attaining the above object, is a delivery method for receiving and transporting a printing product, which is discharged from a printing press, by a delivery conveyor, comprising:

continuously driving the delivery conveyor if a drive speed of the printing press is higher than a predetermined speed, or intermittently driving the delivery conveyor if the drive speed of the printing press is lower than the predetermined speed, thereby delivering the printing product.

According to a ninth aspect of the invention, in the eighth aspect of the invention, a drive speed of the delivery conveyor when intermittently driven may be a minimum drive speed of the delivery conveyor.

According to a tenth aspect of the invention, in the eight aspect of the invention, there may be further included the step of determining a drive time and a stop time of the delivery conveyor based on the drive speed of the printing press when the delivery conveyor is to be intermittently driven.

According to an eleventh aspect of the invention, in the eighth aspect of the invention, there may be further included the steps of determining a drive time of the delivery conveyor based on the drive speed of the printing press when the delivery conveyor is to be intermittently driven, and starting driving of the delivery conveyor at a time when the printing product is completely discharged to the delivery conveyor.

According to a twelfth aspect of the invention, in the eighth aspect of the invention, there may be further included the steps of determining a drive speed and a drive time of the delivery conveyor based on the drive speed of the printing press when the delivery conveyor is to be intermittently driven, and starting driving of the delivery conveyor at a time when the printing product is completely discharged to the delivery conveyor.

According to a thirteenth aspect of the invention, in the twelfth aspect of the invention, the drive time of the delivery conveyor when the delivery conveyor is intermittently driven may be a period of time from complete discharge of the printing product to the delivery conveyor until start of discharge of a next printing product to the delivery conveyor.

According to a fourteenth aspect of the invention, in the eighth aspect of the invention, a maximum drive speed of the delivery conveyor may be not more than 25 times a minimum drive speed of the delivery conveyor.

According to the delivery apparatus and delivery method of the present invention, if the printing press is operated at a higher speed than a predetermined speed, the delivery conveyor is continuously driven; if the printing press is operated at a lower speed than the predetermined speed, the delivery conveyor is intermittently driven. During this intermittent driving, the delivery conveyor moves at its minimum drive speed. Moreover, the drive speed and the stop time of the delivery conveyor are determined according to the drive speed of the printing press, so that the delivery conveyor can have a variable speed range. Thus, the present invention can provide a delivery apparatus having a delivery conveyor driven at a low speed to a high speed with the use of an inexpensive small motor, and a delivery method using the delivery apparatus.

According to the delivery apparatus and delivery method of the present invention, moreover, the drive time of the delivery conveyor is determined based on the drive speed of the printing press, and after the printing product is completely discharged to the delivery conveyor, driving of the delivery conveyor is started. Thus, the delivery conveyor can be controlled reliably.

Furthermore, according to the delivery apparatus and delivery method of the present invention, the drive speed and the drive time of the delivery conveyor are determined based on the drive speed of the printing press, and after the printing product is completely discharged to the delivery conveyor, driving of the delivery conveyor is started. Besides, this drive time of the delivery conveyor is a period of time from complete discharge of the printing product to the delivery conveyor until start of discharge of a next printing product to the delivery conveyor. Because of these features, the delivery conveyor is driven in agreement with the discharge cycle of the printing product, and the delivery conveyor can be stopped until discharge of the next printing product. Hence, the use of an inexpensive small motor enables printing products to be discharged at predetermined intervals, by controlling the intermittent driving of the delivery conveyor.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5A and FIG. 5B are a flow chart for the delivery apparatus and the delivery method according to the first embodiment of the present invention;

FIG. 7A and FIG. 7B are a flow chart for the delivery apparatus and the delivery method according to the second embodiment of the present invention;

FIG. 9A and FIG. 9B are a flow chart for the delivery apparatus and the delivery method according to the third embodiment of the present invention.

DETAILED DESCRIPTION OF THE INVENTION

Figure 1:
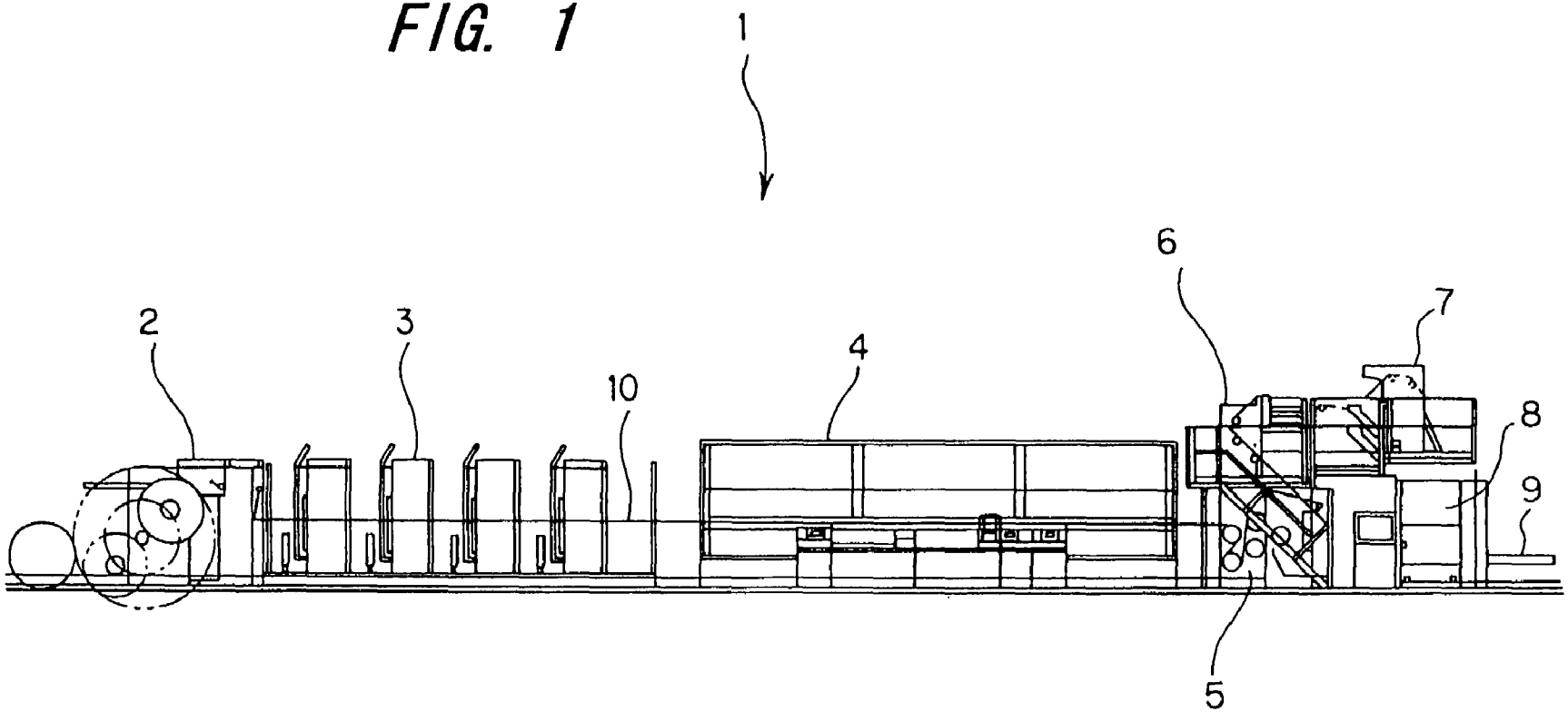
FIG. 1 is a general external view of a web rotary press equipped with a delivery apparatus according to an embodiment of the present invention.
Figure 2:
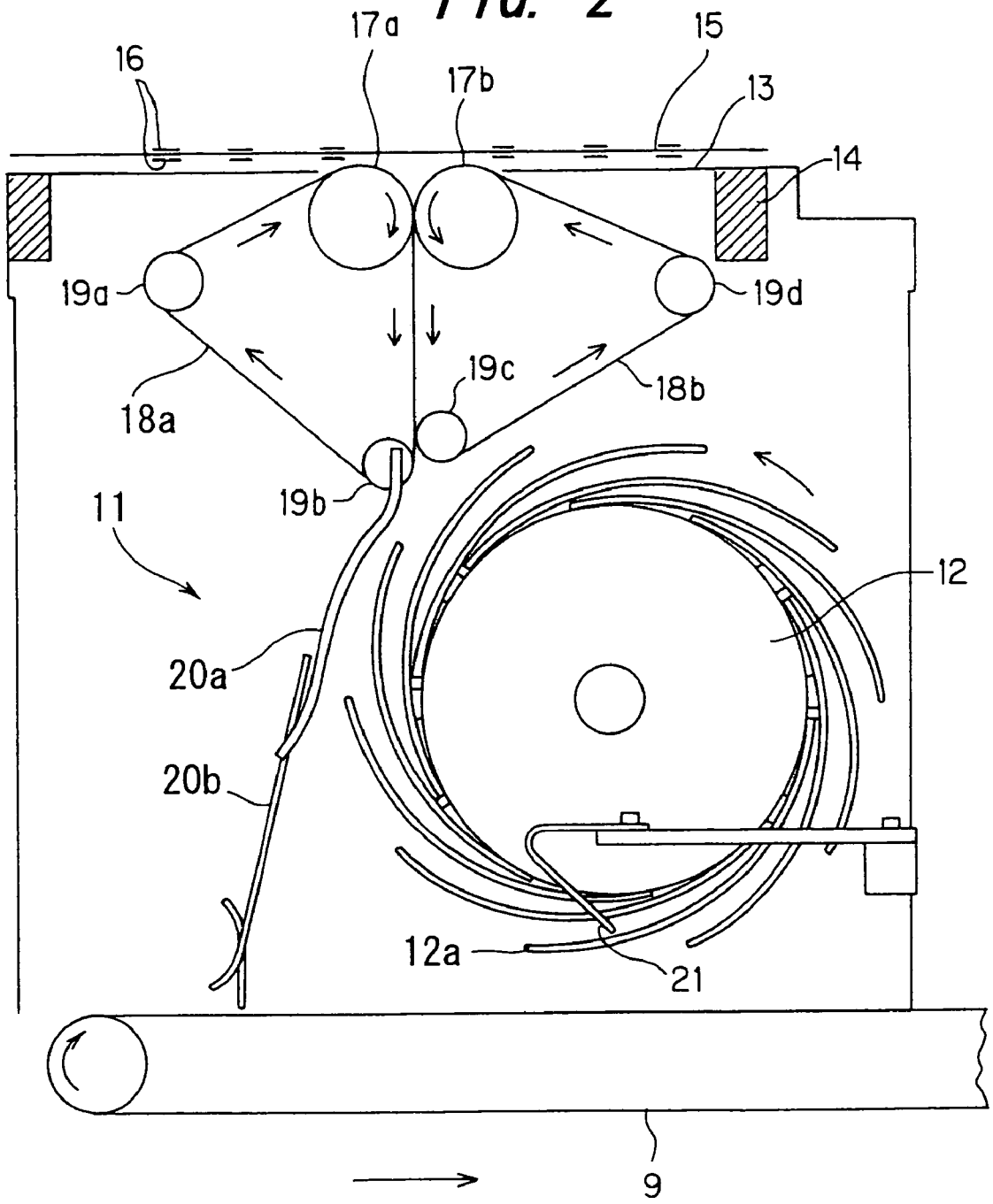
FIG. 2 is a schematic view of the delivery apparatus according to the embodiment of the present invention.

FIG. 1 shows a web rotary press equipped with a delivery apparatus according to an embodiment of the present invention. FIG. 2 shows the delivery apparatus according to the embodiment of the present invention. A web rotary press 1 shown in FIG. 1 is composed of a feeding device 2, a plurality of printing units 3, a dryer 4, a cooling device 5, a web path device 6, a drag device 7, a folder 8, etc. A delivery conveyor 9 is installed adjacent the folder 8. These devices 2 to 8 are connected together by a power transmission mechanism (not shown). Thus, these devices 2 to 8 are interlocked by a drive device, which drives the entire printing press 1, via the power transmission mechanism.

The feeding device 2 transports a web 10, wound in roll form, to the printing units 3 located downstream. The printing units 3 are devices for printing the web 10 transported past the feeding device 2. The dryer 4 is a device for heat-drying the web 10 which has been printed through the printing units 3. The cooling device 5 is a device for cooling the web 10 which has passed through the dryer 4. The web path device 6 is a device for changing the direction of the web 10 in order to control the position and tension of the web 10. The drag device 7 is a device for doubling the web 10 in a width direction.

The folder 8 is a device for cutting and folding the web 10 after drying and cooling. For example, the folder 8 is a device for cutting the web to a predetermined length by a cut-off cylinder (not shown), parallel-folding a cut signature parallel in a lengthwise direction by a folding cylinder (not shown), or doubling a parallel-folded signature in a perpendicular direction by a chopper (not shown). The folder 8 of various structures is available according to combinations of cutting and folding.

A component of a delivery apparatus placed in the folder 8 is the delivery conveyor 9. A delivery apparatus 11 shown in FIG. 2 is composed of the delivery conveyor 9 and a fan wheel 12. In the drawing, the direction of transport of the delivery conveyor 9 and the direction of rotation of the fan wheel 12 are indicated by arrows.

A table 13 has both ends supported by a frame 14. Transport belts 16, which consist of upper and lower belts paired up, are passed over the table 13. Plural sets of the transport belts 16 interpose a signature 15 therebetween, and transport the signature 15. Two folding rolls 17*a*, 17*b* are placed below a middle portion of the table 13. Delivery belts 18*a*, 18*b* are passed over the folding rolls 17*a*, 17*b*, respectively. The delivery belt 18*a* is also passed over rollers 19*a* and 19*b*, and the delivery belt 18*b* is also passed over rollers 19*c* and 19*d*. The directions of rotations of the folding rolls 17*a*, 17*b* are as shown in the drawing, and the delivery belts 18*a*, 18*b* are also rotated in the same directions as these directions of rotations.

The fan wheel 12 is installed below the delivery belts 18*a*, 18*b*, and the delivery conveyor 9 is installed further below the fan wheel 12. Guides 20*a*, 20*b* are installed, beginning at the roller 19*b*, to extend toward the delivery belt 9. A stopper 21 is mounted below the fan wheel 12.

Because of the above-described features, the signature 15 is chopper-folded by a chopper (not shown) located above the table 13. The chopper-folded signature 15 is passed above the table 13, inserted between the rolls 17*a* and 17*b*, interposed between the delivery belts 18*a* and 18*b*, and discharged downward. The discharged signature 15 is transported to a holding portion 12*a* of the fan wheel 12 along the guides 20*a*, 20*b*. The signature 15, held by the holding portion 12*a*, is brought into contact with the stopper 21 in accordance with the rotation of the fan wheel 12, and discharged to the delivery conveyor 9. The discharged signature 15 is delivered to a predetermined position by the delivery conveyor 9.

Figure 3:
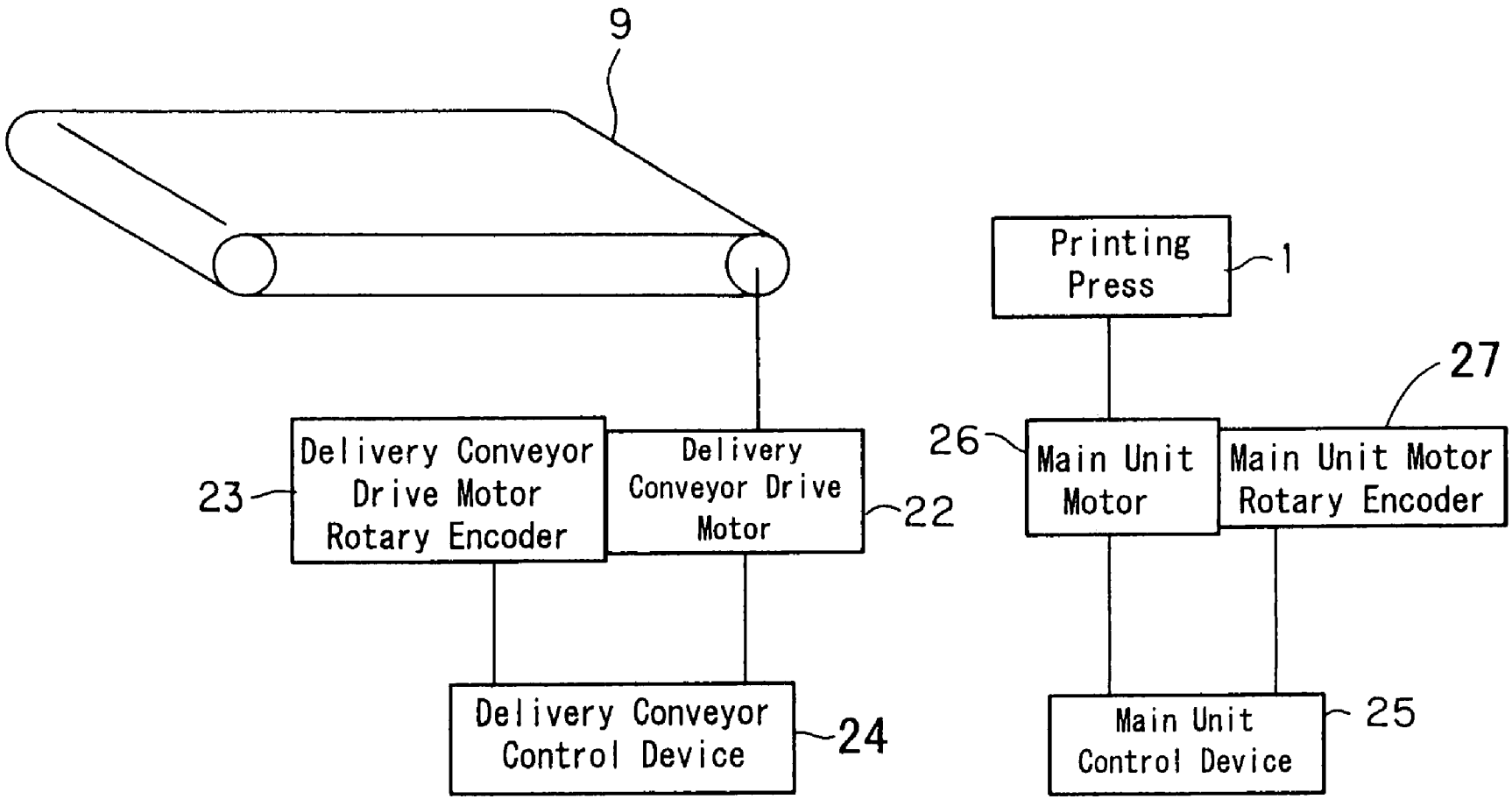
FIG. 3 is a schematic view of a delivery conveyor constituting the delivery apparatus according to the embodiment of the present invention.

FIG. 3 shows a schematic view of the delivery conveyor constituting the delivery apparatus according to the embodiment of the present invention illustrated in FIG. 2. The delivery conveyor 9 is connected to a delivery conveyor drive motor 22. A delivery conveyor drive motor rotary encoder 23 is annexed to the delivery conveyor drive motor 22. The delivery conveyor drive motor 22 and the delivery conveyor drive motor rotary encoder 23 are connected to a delivery conveyor control device 24. The delivery conveyor control device 24 is connected to a main unit control device 25 which controls the printing press 1. A main unit motor 26, and a main unit motor rotary encoder 27 annexed to the main unit motor 26 are connected to the main unit control device 25. The main unit motor 26 is connected to the printing press 1. Thus, the printing press 1 and the delivery conveyor 9 can be driven in an interlocked manner.

Embodiment 1

Figure 4:
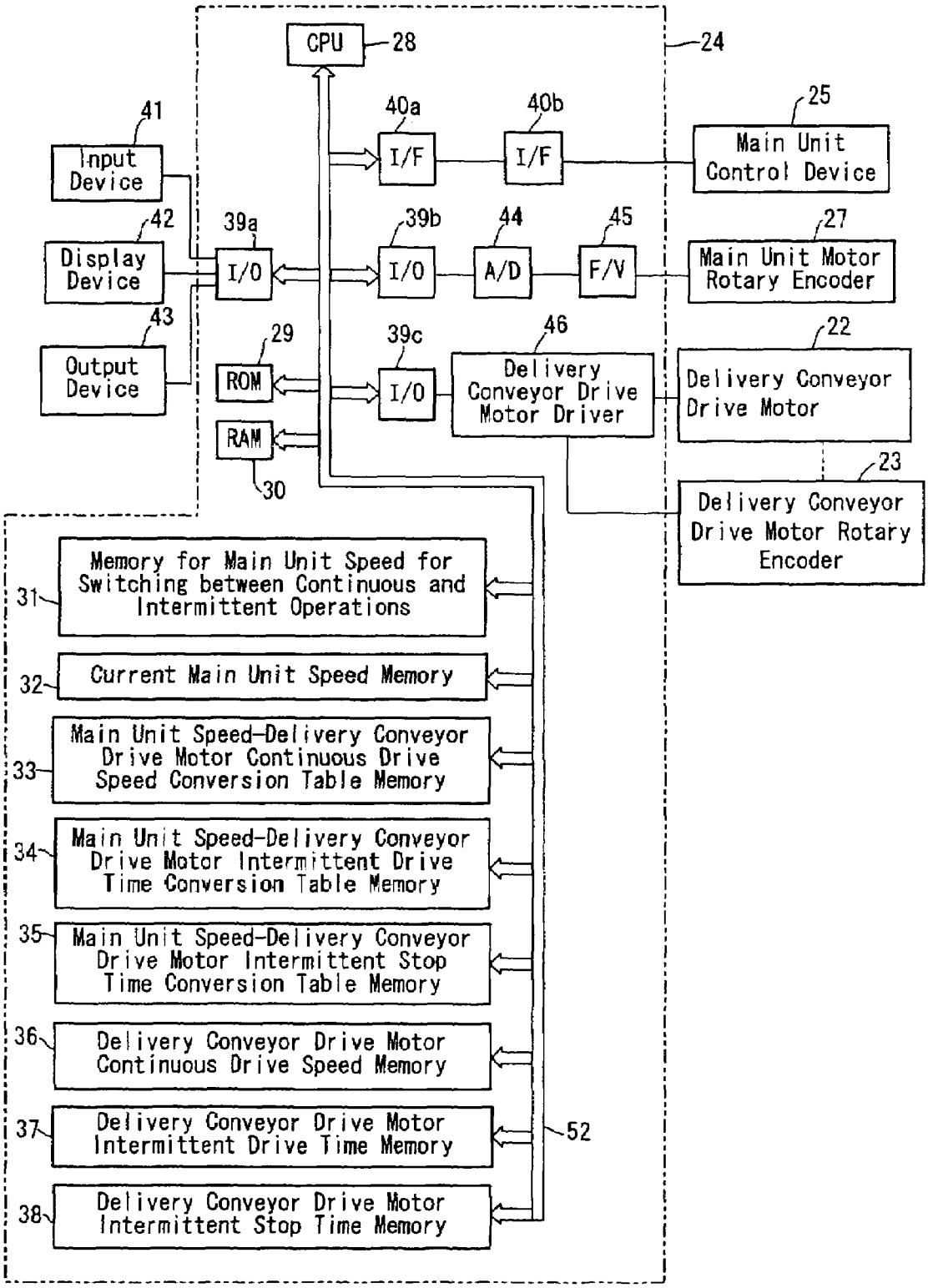
FIG. 4 is a control block diagram of a delivery apparatus and a delivery method according to a first embodiment of the present invention.

FIG. 4 is a control block diagram of a delivery apparatus and a delivery method according to a first embodiment of the present invention.

The delivery conveyor control device 24 comprises a CPU 28, an ROM 29, and an RAM 30, and also includes a memory 31 for a main unit speed for switching between continuous and intermittent operations, a current main unit speed memory 32, a main unit speed-delivery conveyor drive motor continuous drive speed conversion table memory 33, a main unit speed-delivery conveyor drive motor intermittent drive time conversion table memory 34, a main unit speed-delivery conveyor drive motor intermittent stop time conversion table memory 35, a delivery conveyor drive motor continuous drive speed memory 36, a delivery conveyor drive motor intermittent drive time memory 37, and a delivery conveyor drive motor intermittent stop time memory 38. These devices, these memories, input/output devices 39*a* to 39*c*, and an interface 40*a* are connected together by a bus-line BUS 52.

An input device 41, such as a start switch or a key board, a display device 42, such as a display, and an output device 43, such as a printer, are connected to the input/output device 39*a*. The main unit control device 25 is connected to the interface 40*a* via an interface 40*b*. The main unit motor rotary encoder 27 is connected to the input/output device 39*b* via an A/D converter 44 and an F/V converter 45. The delivery conveyor drive motor 22 and the delivery conveyor drive motor rotary encoder 23 are connected to the input/output device 39*c* via a delivery conveyor drive motor driver 46.

According to the above-described features, if the drive speed of the printing press 1 is higher than a predetermined drive speed, the delivery conveyor drive motor 22 can be continuously driven. If the drive speed of the printing press 1 is lower than the predetermined drive speed, the delivery conveyor drive motor 22 can be intermittently driven.

Moreover, the drive speed of the delivery conveyor drive motor 22, when intermittently driven, is the minimum drive speed of the delivery conveyor drive motor 22.

Furthermore, when the delivery conveyor drive motor 22 is to be intermittently driven, the drive time and the stop time of the delivery conveyor drive motor 22 are computed by the aforementioned CPU 28 based on the drive speed of the printing press 1.

Figure 5B:
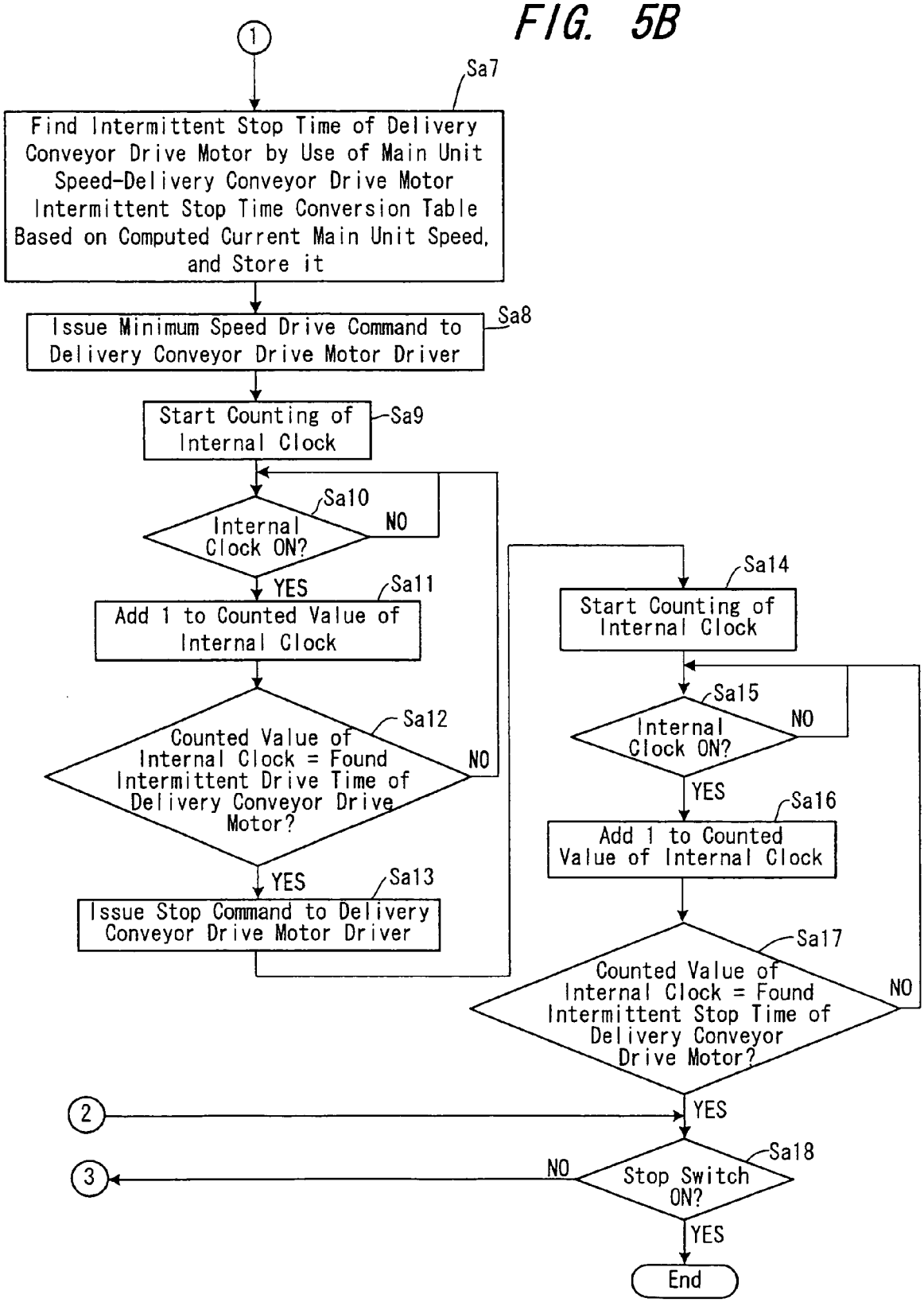

Drive control over the delivery conveyor drive motor 22 for the delivery conveyor 9 will be explained along a flow chart shown in FIG. 5A and FIG. 5B.

In Step Sa1, it is determined whether the start switch is ON. If ON, the program proceeds to Step Sa2. In Step Sa2, the main unit speed for switching between continuous and intermittent operations is loaded from the memory 31 for the main unit speed for switching between continuous and intermittent operations. In Step Sa3, a signal on the drive speed of the printing press 1 outputted from the A/D converter 44 connected to the main unit motor rotary encoder 27 is loaded. In Step Sa4, the CPU 28 computes the drive speed of the printing press 1 from the signal loaded in Step Sa3, and stores the computed results in the current main unit speed memory 32.

In Step Sa5, it is determined whether the current main unit speed computed in Step Sa4 is lower than the main unit speed for switching between continuous and intermittent operations that was loaded in Step Sa2. That is, a determination is made as to whether the drive speed of the printing press 1 is lower than a predetermined speed. If it is lower, the program proceeds to Step Sa6. If not, the program proceeds to Step Sa19.

In Step Sa6, the CPU 28 finds the intermittent drive time of the delivery conveyor drive motor 22 with the use of the main unit speed-delivery conveyor drive motor intermittent drive speed conversion table memory 34 based on the current main unit speed computed in Step Sa4. The results are stored in the delivery conveyor drive motor intermittent drive time memory 37.

In Step Sa7, the CPU 28 finds the intermittent stop time of the delivery conveyor drive motor 22 with the use of the main unit speed-delivery conveyor drive motor intermittent stop time conversion table memory 35 based on the current main unit speed computed in Step Sa4. The results are stored in the delivery conveyor drive motor intermittent stop time memory 38.

In Step Sa8, the CPU 28 issues a minimum speed drive command to the delivery conveyor drive motor driver 46 to output a signal to the delivery conveyor drive motor 22 and drive it at the minimum speed.

In Step Sa9, counting of the internal clock is started. In Step Sa10, it is determined whether the internal clock is ON.

If ON, the program proceeds to Step Sa11. In Step Sa11, 1 is added to the counted value of the internal clock.

In Step Sa12, it is determined whether the counted value of the internal clock is equal to the intermittent drive time of the delivery conveyor drive motor 22 found in Step Sa6. If it is equal, the program proceeds to Step Sa13. If it is not equal, the program returns to Step Sa10 to continue processing in the same manner.

In Step Sa13, the CPU 28 issues a stop command to the delivery conveyor drive motor driver 46 to output a signal to the delivery conveyor drive motor 22 and stop it.

In Step Sa14, counting of the internal clock is started. In Step Sa15, it is determined whether the internal clock is ON. If ON, the program proceeds to Step Sa16. In Step Sa16, 1 is added to the counted value of the internal clock.

In Step Sa17, it is determined whether the counted value of the internal clock is equal to the intermittent stop time of the delivery conveyor drive motor 22 found in Step Sa7. If it is equal, the program proceeds to Step Sa18. If it is not equal, the program returns to Step Sa15 to continue processing in the same manner.

In Step Sa18, it is determined whether the stop switch is ON. If ON, the control ends. If not ON, the program returns to Step Sa3 to continue processing.

If the program proceeds from Step Sa5 to Step Sa19, on the other hand, the CPU 28 obtains the continuous drive speed of the delivery conveyor drive motor 22 with the use of the main unit speed-delivery conveyor drive motor continuous drive speed conversion table memory 33 based on the current main unit speed computed in Step Sa4. The CPU 28 stores the results in the delivery conveyor drive motor continuous drive speed memory 36. In Step Sa20, the CPU 28 issues a drive command for drive at the obtained continuous drive speed to the delivery conveyor drive motor driver 46, thereby driving the delivery conveyor drive motor 22 at the obtained continuous drive speed.

In the present embodiment, as described above, if the printing press 1 operates at a speed higher than a certain drive speed, the delivery conveyor 9 is continuously driven. If the printing press 1 operates at a speed lower than the certain drive speed, the delivery conveyor 9 is intermittently driven. During the intermittent driving of the delivery conveyor 9, the drive speed of the delivery conveyor 9 is a minimum speed. Moreover, the drive speed and the stop time of the delivery conveyor 9 are determined in accordance with the drive speed of the printing press 1. Thus, the delivery conveyor 9 can have a variable speed range. For example, the delivery conveyor drive motor 22 is an inverter motor capable of convenient speed adjustment, and is of a general type having a rotational speed in a variable range of 100 to 2,500 rpm. That is, the delivery conveyor 9 can be driven with a speed variable range of 25 times or less. Thus, it is possible to provide a delivery apparatus of a printing press, which has a delivery conveyor driven at a low speed to a high speed with the use of an inexpensive small motor, and a delivery method using the delivery apparatus.

Embodiment 2

Figure 6:
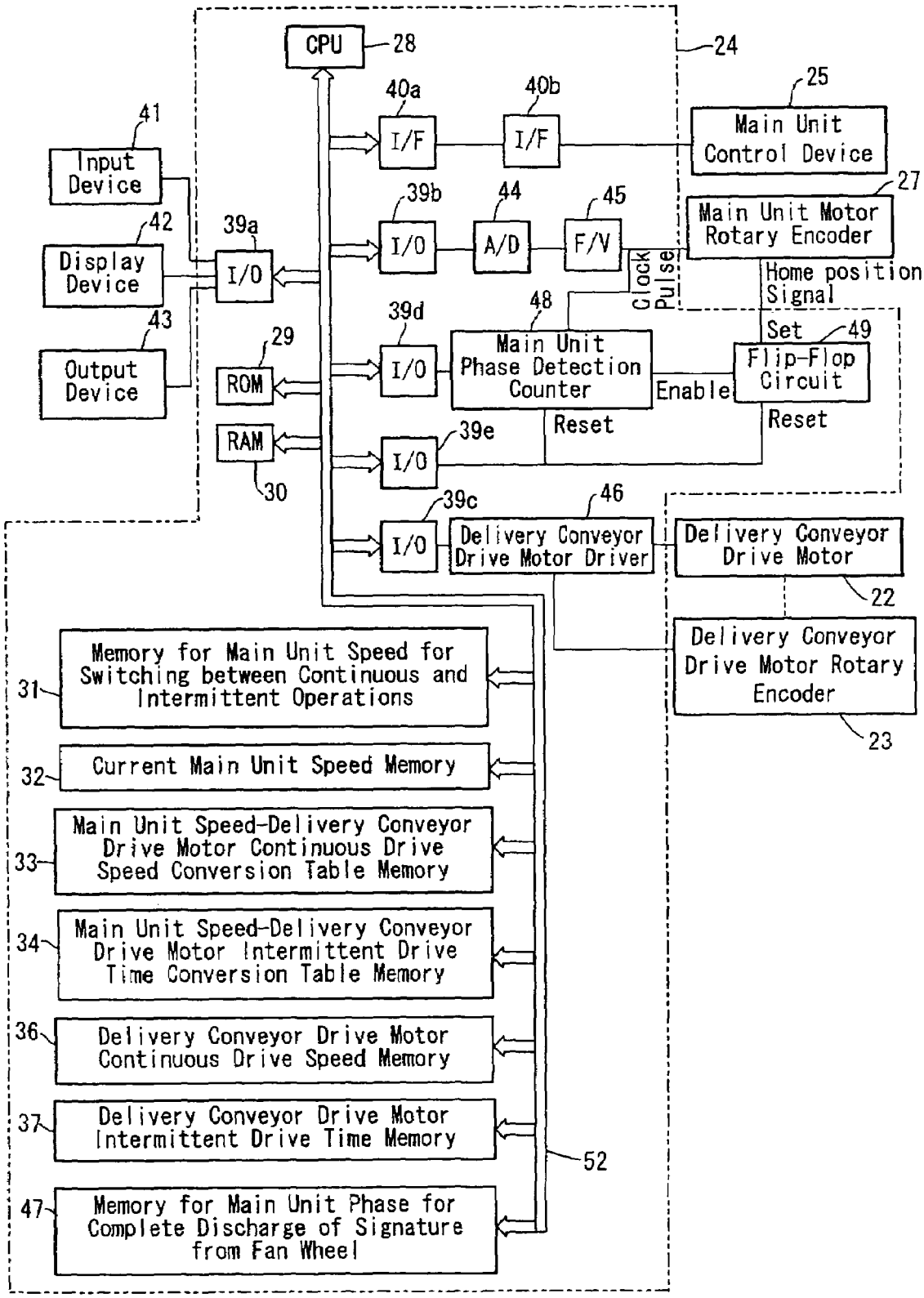
FIG. 6 is a control block diagram of a delivery apparatus and a delivery method according to a second embodiment of the present invention.

FIG. 6 is a control block diagram of a delivery apparatus and a delivery method according to a second embodiment of the present invention. This embodiment involves changes in the features of the delivery conveyor control device 24.

The delivery conveyor control device 24 comprises a CPU 28, an ROM 29, and an RAM 30, and also includes a memory 31 for a main unit speed for switching between continuous and intermittent operations, a current main unit speed memory 32, a main unit speed-delivery conveyor drive motor continuous drive speed conversion table memory 33, a main unit speed-delivery conveyor drive motor intermittent drive time conversion table memory 34, a delivery conveyor drive motor continuous drive speed memory 36, a delivery conveyor drive motor intermittent drive time memory 37, and a memory 47 for a main unit phase for complete discharge of a signature from a fan wheel. These devices, these memories, input/output devices 39*a* to 39*e*, and an interface 40*a* are connected together by a bus-line BUS 52.

An input device 41, such as a start switch or a key board, a display device 42, such as a display, and an output device 43, such as a printer, are connected to the input/output device 39*a*. The main unit control device 25 is connected to the interface 40*a* via an interface 40*b*. The main unit motor rotary encoder 27 is connected to the input/output device 39*b* via an A/D converter 44 and an F/V converter 45. A main unit phase detection counter 48 is connected to the input/output device 39*d*. The main unit phase detection counter 48 is connected to the main unit motor rotary encoder 27 via a flip-flop circuit 49. A detection signal (clock pulse) of the main unit motor rotary encoder 27 is entered into the main unit phase detection counter 48. The main unit phase detection counter 48 and the flip-flop circuit 49 are connected to the input/output device 39*e*. The delivery conveyor drive motor 22 and the delivery conveyor drive motor rotary encoder 23 are connected to the input/output device 39*c* via a delivery conveyor drive motor driver 46.

According to the above-described features, when the delivery conveyor drive motor 22 is to be intermittently driven, the drive time of the delivery conveyor drive motor 22 is computed by the CPU 28 based on the drive speed of the printing press 1, and when the signature 15 is completely discharged to the delivery conveyor 9, driving of the delivery conveyor drive motor 22 is started.

Drive control over the delivery conveyor drive motor 22 for the delivery conveyor 9 will be explained along a flow chart shown in FIG. 7A and FIG. 7B.

In Step Sb1, it is determined whether the start switch is ON. If ON, the program proceeds to Step Sb2. In Step Sb2, the main unit speed for switching between continuous and intermittent operations is loaded from the memory 31 for the main unit speed for switching between continuous and intermittent operations. In Step Sb3, a signal on the drive speed of the printing press 1 outputted from the A/D converter 44 connected to the main unit motor rotary encoder 27 is loaded. In Step Sb4, the CPU 28 computes the drive speed of the printing press 1 from the signal loaded in Step Sb3, and stores the computed results in the current main unit speed memory 32.

In Step Sb5, it is determined whether the current main unit speed computed in Step Sb4 is lower than the main unit speed for switching between continuous and intermittent operations that was loaded in Step Sb2. That is, a determination is made as to whether the drive speed of the printing press 1 is lower than a predetermined speed. If it is lower, the program proceeds to Step Sb6. If not, the program proceeds to Step Sb19.

In Step Sb6, the CPU 28 finds the intermittent drive time of the delivery conveyor drive motor 22 with the use of the main unit speed-delivery conveyor drive motor intermittent drive time conversion table memory 34 based on the current main unit speed computed in Step Sb4. The results are stored in the delivery conveyor drive motor intermittent drive time memory 37.

In Step Sb7, the phase of the main unit, in which the signature 15 is completely discharged from the fan wheel 12, is read from the memory 47 for a main unit phase for complete discharge of the signature. In Step Sb8, a counted value is read from the main unit phase detection counter 48.

In Step Sb9, it is determined whether the counted value read in Step Sb8 is equal to the main unit phase for complete discharge of the signature 15 from the fan wheel 12 that was read in Step Sb7. If it is equal, the program proceeds to Step Sb10. If it is not equal, the program returns to Step Sb8 to continue processing.

In Step Sb10, a reset signal is outputted to the main unit phase detection counter 48 and the flip-flop circuit 49. In Step Sb11, the CPU 28 issues a minimum speed drive command to the delivery conveyor drive motor driver 46 to output a signal to the delivery conveyor drive motor 22 and drive it at the minimum speed.

In Step Sb12, counting of the internal clock is started. In Step Sb13, it is determined whether the internal clock is ON. If ON, the program proceeds to Step Sb14. In Step Sb14, 1 is added to the counted value of the internal clock.

In Step Sb15, it is determined whether the counted value of the internal clock is equal to the intermittent drive time of the delivery conveyor drive motor 22 found in Step Sb6. If it is equal, the program proceeds to Step Sb16. If it is not equal, the program returns to Step Sb13 to continue processing in the same manner.

In Step Sb16, the CPU 28 issues a stop command to the delivery conveyor drive motor driver 46 to output a signal to the delivery conveyor drive motor 22 and stop it. In Step Sb18, it is determined whether the stop switch is ON. If ON, the control ends. If not ON, the program returns to Step Sb3 to continue processing.

If the program proceeds from Step Sb5 to Step Sb19, on the other hand, the CPU 28 obtains the continuous drive speed of the delivery conveyor drive motor 22 with the use of the main unit speed-delivery conveyor drive motor continuous drive speed conversion table memory 33 based on the current main unit speed computed in Step Sb4. The CPU 28 stores the results in the delivery conveyor drive motor continuous drive speed memory 36. In Step Sb20, the CPU 28 issues a drive command for drive at the obtained continuous drive speed to the delivery conveyor drive motor driver 46, thereby driving the delivery conveyor drive motor 22 at the obtained continuous drive speed.

In the present embodiment, as described above, the drive time of the delivery conveyor 9 is determined based on the drive speed of the printing press 1, and after the signature 15 is completely discharged to the delivery conveyor 9, driving of the delivery conveyor 9 is started. Thus, the signature 15 is stably discharged to the delivery conveyor 9, and the intermittent drive time and the intermittent stop time of the delivery conveyor 9 can be controlled reliably.

Embodiment 3

Figure 8:
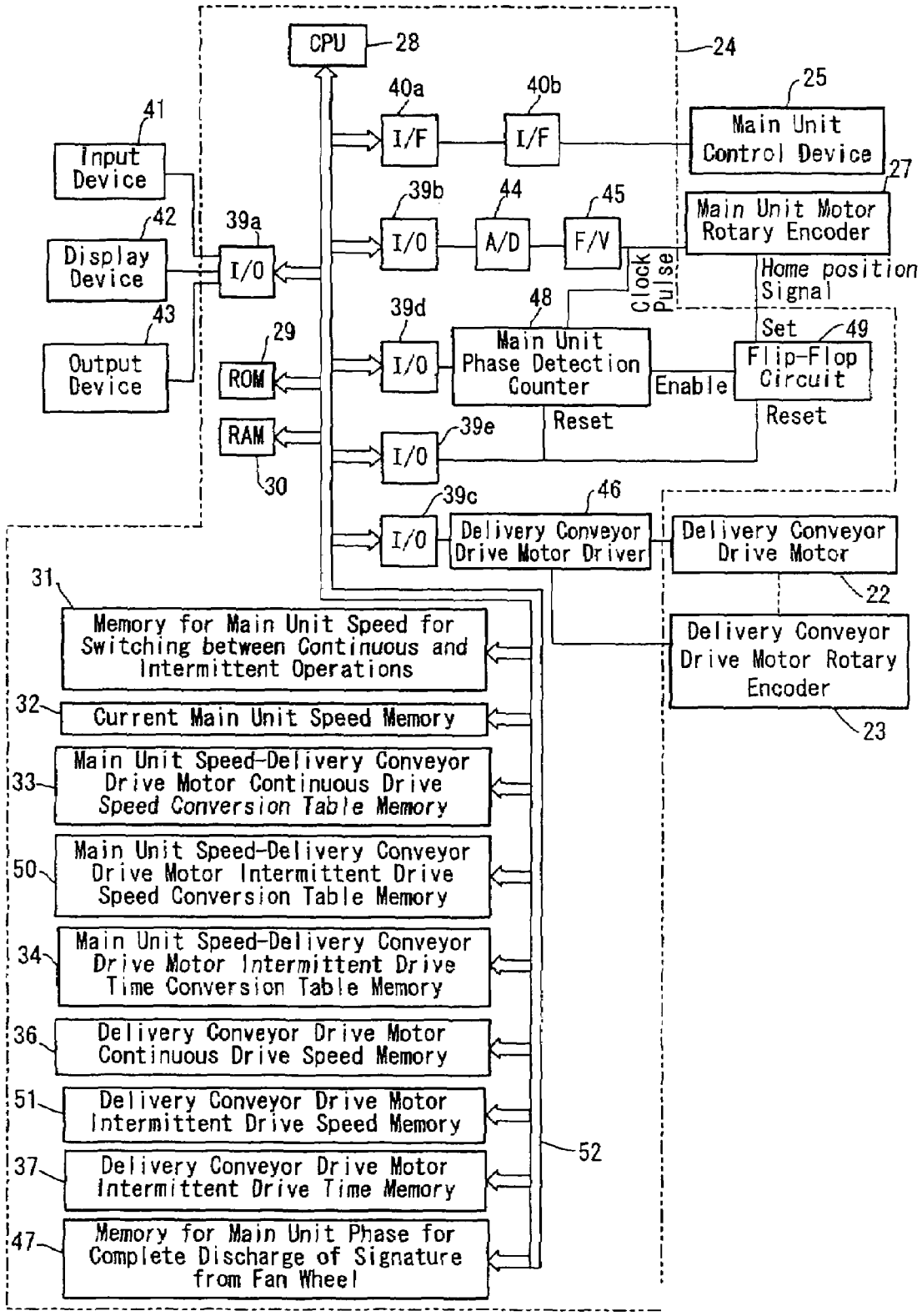
FIG. 8 is a control block diagram of a delivery apparatus and a delivery method according to a third embodiment of the present invention.

FIG. 8 is a control block diagram of a delivery apparatus and a delivery method according to a third embodiment of the present invention. This embodiment also involves changes in the features of the delivery conveyor control device 24.

The delivery conveyor control device 24 comprises a CPU 28, an ROM 29, and an RAM 30, and also includes a memory 31 for a main unit speed for switching between continuous and intermittent operations, a current main unit speed memory 32, a main unit speed-delivery conveyor drive motor continuous drive speed conversion table memory 33, a main unit speed-delivery conveyor drive motor intermittent drive speed conversion table memory 50, a main unit speed-delivery conveyor drive motor intermittent drive time conversion table memory 34, a delivery conveyor drive motor intermittent drive speed memory 51, a delivery conveyor drive motor continuous drive speed memory 36, a delivery conveyor drive motor intermittent drive time memory 37, and a memory 47 for a main unit phase for complete discharge of a signature from a fan wheel. These devices, these memories, input/output devices 39*a* to 39*e*, and an interface 40*a* are connected together by a bus-line BUS 52.

An input device 41, such as a start switch or a key board, a display device 42, such as a display, and an output device 43, such as a printer, are connected to the input/output device 39*a*. The main unit control device 25 is connected to the interface 40*a* via an interface 40*b*. The main unit motor rotary encoder 27 is connected to the input/output device 39*b* via an A/D converter 44 and an F/V converter 45. A main unit phase detection counter 48 is connected to the input/output device 39*d*. The main unit phase detection counter 48 is connected to the main unit motor rotary encoder 27 via a flip-flop circuit 49. A detection signal (clock pulse) of the main unit motor rotary encoder 27 is entered into the main unit phase detection counter 48. The main unit phase detection counter 48 and the flip-flop circuit 49 are connected to the input/output device 39*e*. The delivery conveyor drive motor 22 and the delivery conveyor drive motor rotary encoder 23 are connected to the input/output device 39*c* via a delivery conveyor drive motor driver 46.

According to the above-described features, when the delivery conveyor drive motor 22 is to be intermittently driven, the drive speed and the drive time of the delivery conveyor drive motor 22 are computed by the CPU 28 based on the drive speed of the printing press 1, and when the signature 15 is completely discharged to the delivery conveyor 9, driving of the delivery conveyor drive motor 22 is started.

In the above-described case, when the delivery conveyor drive motor 22 is to be intermittently driven, the drive time of the delivery conveyor drive motor 22 is a period of time from complete discharge of the signature 15 to the delivery conveyor 9 until start of discharge of a next signature 15 to the delivery conveyor 9.

Drive control over the delivery conveyor drive motor 22 for the delivery conveyor 9 will be explained along a flow chart shown in FIG. 9A and FIG. 9B.

In Step Sc1, it is determined whether the start switch is ON. If ON, the program proceeds to Step Sc2. In Step Sc2, the main unit speed for switching between continuous and intermittent operations is loaded from the memory 31 for a main unit speed for switching between continuous and intermittent operations. In Step Sc3, a signal on the drive speed of the printing press 1 outputted from the A/D converter 44 connected to the main unit motor rotary encoder 27 is loaded. In Step Sc4, the CPU 28 computes the drive speed of the printing press 1 from the signal loaded in Step Sc3, and stores the computed results in the current main unit speed memory 32.

In Step Sc5, it is determined whether the current main unit speed computed in Step Sc4 is lower than the main unit speed for switching between continuous and intermittent operations that was loaded in Step Sc2. That is, a determination is made as to whether the drive speed of the printing press 1 is lower than a predetermined speed. If it is lower, the program proceeds to Step Sc6. If not, the program proceeds to Step Sc19.

In Step Sc6, the CPU 28 finds the intermittent drive speed of the delivery conveyor drive motor 22 with the use of the main unit speed-delivery conveyor drive motor intermittent drive speed conversion table memory 50 based on the current main unit speed computed in Step Sc4. The results are stored in the delivery conveyor drive motor intermittent drive speed memory 51.

In Step Sc7, the CPU 28 finds the intermittent drive time of the delivery conveyor drive motor 22 with the use of the main unit speed-delivery conveyor drive motor intermittent drive time conversion table memory 34 based on the current main unit speed computed in Step Sc4. The results are stored in the delivery conveyor drive motor intermittent drive time memory 37.

In Step Sc8, the phase of the main unit, in which the signature 15 is completely discharged from the fan wheel 12, is read from the memory 47 for main unit phase for complete discharge of the signature. In Step Sc9, a counted value is read from the main unit phase detection counter 48.

In Step Sc10, it is determined whether the counted value read in Step Sc9 is equal to the main unit phase for complete discharge of the signature 15 from the fan wheel 12 that was read in Step Sc8. If it is equal, the program proceeds to Step Sc11. If it is not equal, the program returns to Step Sc9 to continue processing.

In Step Sc11, a reset signal is outputted to the main unit phase detection counter 48 and the flip-flop circuit 49. In Step Sc12, the CPU 28 issues a drive command to the delivery conveyor drive motor driver 46 for driving of the delivery conveyor drive motor at the intermittent drive speed found in Step Sc6, thereby outputting a signal to the delivery conveyor drive motor 22 and driving it at that speed.

In Step Sc13, counting of the internal clock is started. In Step Sc14, it is determined whether the internal clock is ON. If ON, the program proceeds to Step Sc15. In Step Sc15, 1 is added to the counted value of the internal clock.

In Step Sc16, it is determined whether the counted value of the internal clock is equal to the intermittent drive time of the delivery conveyor drive motor 22 found in Step Sc7. If it is equal, the program proceeds to Step Sc17. If it is not equal, the program returns to Step Sc14 to continue processing in the same manner.

In Step Sc17, the CPU 28 issues a stop command to the delivery conveyor drive motor driver 46 to output a signal to the delivery conveyor drive motor 22 and stop it. In Step Sc18, it is determined whether the stop switch is ON. If ON, the control ends. If not ON, the program returns to Step Sc3 to continue processing.

If the program proceeds from Step Sc5 to Step Sc19, on the other hand, the CPU 28 obtains the continuous drive speed of the delivery conveyor drive motor 22 with the use of the main unit speed-delivery conveyor drive motor continuous drive speed conversion table memory 33 based on the current main unit speed computed in Step Sc4. The CPU 28 stores the results in the delivery conveyor drive motor continuous drive speed memory 36. In Step Sc20, the CPU 28 issues a drive command for drive at the obtained continuous drive speed to the delivery conveyor drive motor driver 46, thereby driving the delivery conveyor drive motor 22 at the obtained continuous drive speed.

In the present embodiment, as described above, the drive speed and the drive time of the delivery conveyor 9 are determined based on the drive speed of the printing press 1, and after the signature 15 is completely discharged to the delivery conveyor 9, driving of the delivery conveyor 9 is started. Moreover, the drive time of the delivery conveyor in this case is a period of time from complete discharge of the signature 15 to the delivery conveyor 9 until start of discharge of a next signature 15 to the delivery conveyor 9. Thus, the delivery conveyor 9 can be driven in agreement with the discharge cycle of the signature 15, and the delivery conveyor 9 can be stopped until discharge of the next signature 15. Hence, the signature 15 is stably discharged to the delivery conveyor 9. Besides, by controlling the intermittent driving of the delivery conveyor 9, the signatures 15 can be discharged at predetermined intervals even with the use of an inexpensive small motor.

As noted above, the delivery conveyor is usable as a delivery conveyor of a printing press using an inexpensive, small motor.

While the present invention has been described by the above embodiments, it is to be understood that the invention is not limited thereby, but may be varied or modified in many other ways. Such variations or modifications are not to be regarded as a departure from the spirit and scope of the invention, and all such variations and modifications as would be obvious to one skilled in the art are intended to be included within the scope of the appended claims.

What is claimed is:

1. A delivery apparatus, comprising:

a drive speed detecting unit that detects a drive speed of a printing press;

a memory for storing main unit speed for switching between a continuous operation and an intermittent operation;

a delivery conveyor for receiving and transporting a printing product discharged from the printing press; and a controller that continuously drives said delivery conveyor when a detected drive speed of said printing press is higher than the stored main unit speed, and intermittently drives said delivery conveyor when the detected drive speed of said printing press is lower than the stored main unit, wherein all of adjacent printing products from the printing press are discharged to said delivery conveyor in an overlapping state during a normal printing operation.

2. The delivery apparatus according to claim 1, wherein: said delivery conveyor has a minimum drive speed; and the drive speed of said delivery conveyor when intermittently driven is the minimum drive speed of said delivery conveyor.

3. The delivery apparatus according to claim 1, wherein a drive time and a stop time of said delivery conveyor when intermittently driven are determined based on said detected drive speed of said printing press.

4. The delivery apparatus according to claim 1, wherein when said delivery conveyor is to be intermittently driven, a drive time of said delivery conveyor is determined based on said detected drive speed of said printing press, and at a time when said printing product is completely discharged to said delivery conveyor, driving of said delivery conveyor is started.

5. The delivery apparatus according to claim 1, wherein when said delivery conveyor is to be intermittently driven, a drive speed and a drive time of said delivery conveyor are determined based on said detected drive speed of said printing press, and at a time when said printing product is completely discharged to said delivery conveyor, driving of said delivery conveyor is started.

6. The delivery apparatus according to claim 5, wherein when said delivery conveyor is to be intermittently driven, said drive time of said delivery conveyor is a period of time from complete discharge of said printing product to said delivery conveyor until start of discharge of a next printing product to said delivery conveyor.

7. The delivery apparatus according to claim 1, further comprising:

a drive device for driving said delivery conveyor, wherein a maximum drive speed of said drive device is not more than 25 times a minimum drive speed of said drive device.

8. A delivery method for receiving and transporting a printing product, discharged from a printing press, by a delivery conveyor, comprising:

detecting a drive speed of a printing press;

storing a main unit speed for switching between a continuous operation and an intermittent operation, continuously driving said delivery conveyor when the detected drive speed of said printing press is higher than the stored main unit speed; and intermittently driving said delivery conveyor when the detected drive speed of said printing press is lower than the stored main unit speed, wherein all of adjacent printing products from the printing press are discharged to said delivery conveyor during a normal printing operation in an overlapping state.

9. The delivery method according to claim 8, wherein said delivery conveyor has a minimum drive speed; and the drive speed of said delivery conveyor when intermittently driven is the minimum drive speed of said delivery conveyor.

10. The delivery method according to claim 8, further comprising:

determining a drive time and a stop time of said delivery conveyor based on said detected drive speed of said printing press when said delivery conveyor is to be intermittently driven.

11. The delivery method according to claim 8, further comprising:

determining a drive time of said delivery conveyor based on said detected drive speed of said printing press when said delivery conveyor is to be intermittently driven; and starting driving of said delivery conveyor at a time when said printing product is completely discharged to said delivery conveyor.

12. The delivery method according to claim 8, further comprising:

determining a drive speed and a drive time of said delivery conveyor based on said detected drive speed of said printing press when said delivery conveyor is to be intermittently driven; and starting driving of said delivery conveyor at a time when said printing product is completely discharged to said delivery conveyor.

13. The delivery method according to claim 12, wherein said drive time of said delivery conveyor when said delivery conveyor is intermittently driven is a period of time from complete discharge of said printing product to said delivery conveyor until start of discharge of a next printing product to said delivery conveyor.

14. The delivery method according to claim 8, wherein a maximum drive speed of said delivery conveyor is not more than 25 times a minimum drive speed of said delivery conveyor.

* * * * *